US005881484A

United States Patent [19]

Carroll

[11] Patent Number: 5,881,484

[45] Date of Patent: Mar. 16, 1999

[54] DISPLAY DEVICE FOR SIMULTANEOUSLY DISPLAYING A PLURALITY OF ARTICLES

[75] Inventor: Joseph P. Carroll, 777 Pinewood Dr., San Jose, Calif. 95129

[73] Assignee: Joseph P. Carroll, Los Gatos, Calif.

[21] Appl. No.: 794,037

[22] Filed: Feb. 3, 1997

[51] Int. Cl.[6] ..... G09F 3/20

[52] U.S. Cl. ..... 40/649; 40/611; 40/661.03

[58] Field of Search ..... 40/649, 661.01, 40/661.03, 600, 621, 611

[56] References Cited

U.S. PATENT DOCUMENTS

| | | | |
|---|---|---|---|
| 2,331,086 | 10/1943 | Taylor | 40/649 |
| 2,990,196 | 6/1961 | Slavsky | 40/661.03 |
| 4,450,955 | 5/1984 | Featherston | 40/649 |
| 4,753,026 | 6/1988 | Woodman et al. | 10/649 |

*Primary Examiner*—William Stryjewski
*Attorney, Agent, or Firm*—Steven F. Caserza; Flehr Hohbach Test Albritton & Herbert LLP

[57] ABSTRACT

A display device for displaying selected portions of a plurality of sheet-like articles. The display device includes a base member mountable to a vertically-extending structure and retaining rails extending inwardly across the front surface of the base member from the elongate edges of the base member. The retaining rails define channels between the underside of the retaining rails and the front surface of the base member. The retaining rails are spaced from the front surface of the base member by a distance such that the retaining rails hold a plurality of articles in a selected display configuration independent of the orientation of the display device and such that the articles retained by the retaining rails are movable relative to the base member upon application of pressure to the portion of the articles exposed through the opening defined by the retaining rails to slide the articles along the channel.

19 Claims, 3 Drawing Sheets

DISPLAY DEVICE FOR SIMULTANEOUSLY DISPLAYING A PLURALITY OF ARTICLES

BRIEF DESCRIPTION OF THE INVENTION

This invention relates in general to a device for displaying a plurality of articles and, more particularly, to a photograph frame structure for displaying several photographs.

BACKGROUND OF THE INVENTION

Various devices have been employed to temporarily display photographs and other articles. Often, the articles are temporarily affixed to a refrigerator, filing cabinet, and the like using one or more magnets. While the magnets provide a simple method of mounting the photographs to the surface, the photographs tend to curl or become deformed unless several magnets are used for each photograph. If the photographs or other articles are overlapped, allowing a greater number of photographs to be displayed in a limited area, the magnets will not securely hold the photographs in place causing the photographs to slip or even fall from the surface. Moreover, the resulting display is often disorganized and aesthetically unpleasant. Other means may be used to attach the photographs to a surface such as push pins and adhesive, although these attachment methods may damage the photographs or the surface to which the articles are mounted.

One type of magnetic holder available in the art consists of a U-shaped frame which includes a front panel covering the front surface of the photograph and a magnet affixed to the panel for mounting the holder to a surface. U.S. Pat. No. 5,274,937 discloses an example of such a magnetic holder. While the U-shaped frame eliminates the problem of curling, this type of holder is generally not suitable for simultaneously display several photographs or articles particularly if the user wishes to overlap the photographs to display only the desired portion of each photograph. In addition, inserting the photograph into the frame may be difficult as the front and back panels must be pried apart while the photograph is slipped into place.

A display structure which may be used to conveniently and attractively display several photographs or articles is desirable. A display structure in which the photographs or other articles may be easily positioned in the display and moved to the desired position is also desirable.

OBJECTS AND SUMMARY OF THE INVENTION

It is an object of the present invention to provide a display structure for simultaneously displaying a plurality of photographs or other articles.

It is a further object of the present invention to provide a display structure which may be used to display selected portions of one or more of the articles.

It is another object of the present invention to provide a display structure in which the photographs or other articles may be easily and quickly positioned in the display structure and moved to the desired position.

A more general object of the present invention to provide a display structure for temporarily displaying a plurality of photographs and other articles in an organized and aesthetically pleasing configuration.

In summary, the invention provides a display device for displaying a portion of a plurality of sheet-like articles such as photographs and the like. The display device includes a base member having a back surface mountable to a vertically-extending structure, a front surface, spaced first and second elongate edges and spaced first and second side edges joining the elongate edges. Retaining rails extend inwardly across the front surface of the base member from each of the elongate edges. The retaining rails define channels between the underside of the retaining rails and the front surface of the base member. The retaining rails have an inner edge which defines an opening exposing a portion of the front surface of the base member. The retaining rails are spaced from the front surface of the base member by a distance such that the retaining rails hold a plurality of articles in a selected display configuration independent of the orientation of the display device. The distance between the front surface of the base member and the retaining rails is also selected such that the articles retained by the retaining rails are movable relative to the base member upon application of pressure to the portion of the articles exposed through the opening to slide the articles into a display configuration with at least one of the articles extending across at least a portion of another of the articles.

Additional objects and features of the invention will be more readily apparent from the following detailed description and appended claims when taken in conjunction with the drawings.

BRIEF DESCRIPTION OF THE DRAWINGS

The foregoing and other objects of the invention will be more readily apparent from the following detailed description and appended claims when taken in conjunction with the drawings of which:

DETAILED DESCRIPTION OF THE INVENTION

Figure 1:
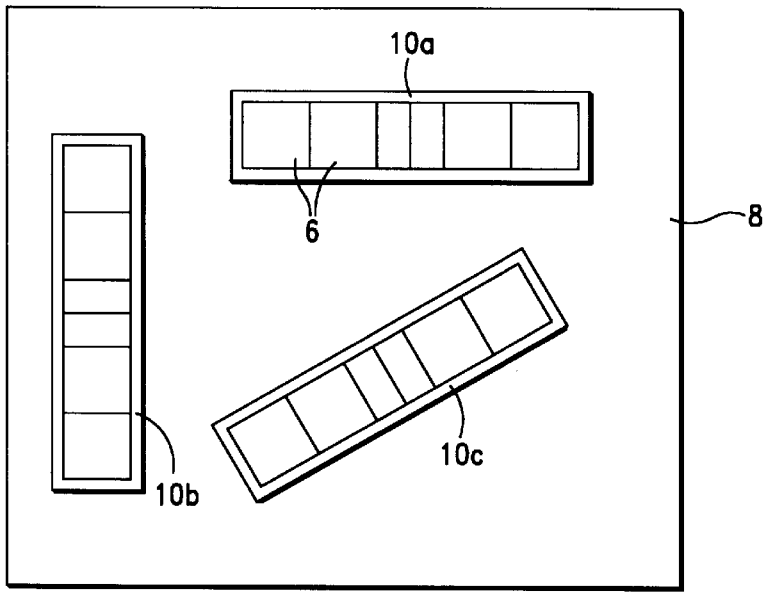
FIG. 1 is a front plan view of display devices in accordance with this invention, shown mounted to a vertical structure.

Reference will now be made in detail to the preferred embodiment of the invention, which is illustrated in the accompanying figures. Turning now to the drawings, wherein like components are designated by like reference numerals throughout the various figures, attention is directed to FIGS. 1 and 2.

Figure 2:
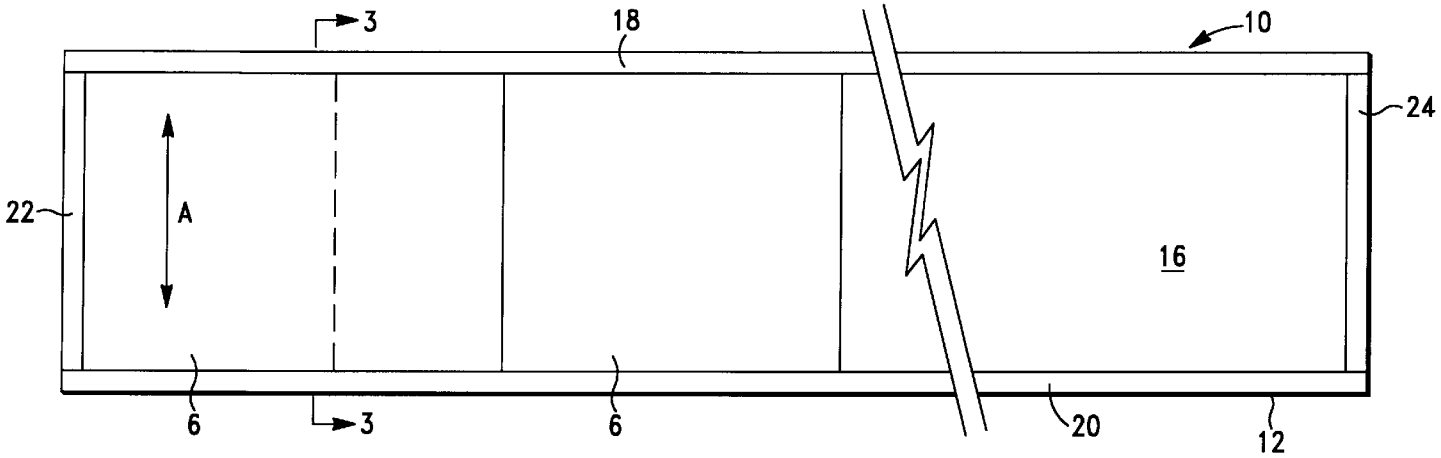
FIG. 2 is a front plan view of the display device of FIG. 1, shown displaying a plurality of articles.

FIGS. 1 and 2 show a display device 10, constructed in accordance with this invention, which is particularly suitable for displaying a plurality of articles including, but not limited to, photographs, post cards, calendar sheets, recipe cards, note cards, pads of note sheets, and the like. As is shown particularly in FIG. 1, the display device 10 is installed by mounting the device to a vertically-extending surface such as the door of a refrigerator, a filing cabinet, a wall or cubicle partition, and the like. Preferably, the display device is mounted to the vertical surface 8 before the photographs 6 or other articles are positioned in the display, although if desired the articles may be inserted before the display device is installed. As is described in more detail below, the photographs may be inserted into the display 10, rearranged, and removed while the display device is mounted to the vertically extending surface. The display device 10 may be positioned in any desired orientation, including the horizontal, vertical and diagonal examples shown in FIG. 1. The display device of this invention provides a convenient and useful means of temporarily displaying several photographs or other articles in an organized manner.

The display device of this invention is described in greater detail in relation to FIGS. 2–6. Display device 10 generally includes a base member 12 having a back surface 14 which is mounted to the vertical surface of the refrigerator, wall or other structure and a front surface 16. Retaining rails 18 and 20 extend along the elongated edges of the base member 12 for holding the photographs or other articles in the desired display configuration. Side rails 22 and 24 are provided along the side edges of the display device to provide the display device with the appearance of a uniform frame extending around the entire circumference of the device. Providing the side rails 22 and 24 with the same thickness as the retaining rails 18 and 20 enhances the aesthetic appearance of the display device 10. The side rails 22 and 24 may have a substantially uniform thickness as in the present embodiment. Instead of solid members, the side rails 22 and 24 may have the same shape as the retaining rails 18 and 20, which shape is described in more detail below.

In the illustrated embodiment, the base member 12 and retaining rails 18 and 20 are integrally formed as a single unit, although it is to be understood that the retaining rails may be formed separately and then mounted to the base member 12. The base member 12 and retaining rails 18 and 20 are formed of a rigid material such as high impact polystyrene, and may be fabricated using any suitable process including for example extrusion, injection molding, casting and hand fabrication. The side rails 22 and 24 are formed of the same material as the base member 12 and retaining rails 22 and 24. The side rails may be separately mounted to the base member 12 as in the illustrated embodiment or the side rails may be integrally formed with the base member 12 and retaining rails 18 and 20.

Figure 3:
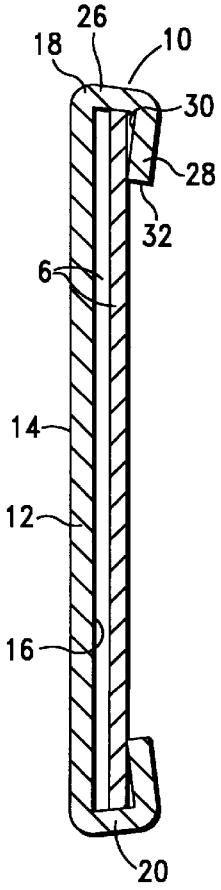
FIG. 3 is a sectional view taken substantially along line 3–3 of FIG. 2.
Figure 4:
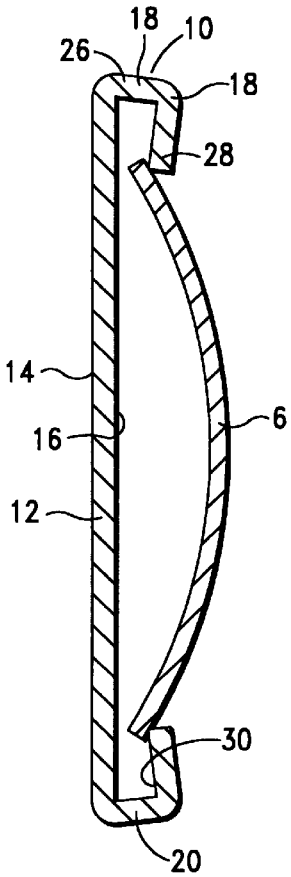
FIG. 4 is a sectional view showing insertion of an article into the display device.
Figure 5:
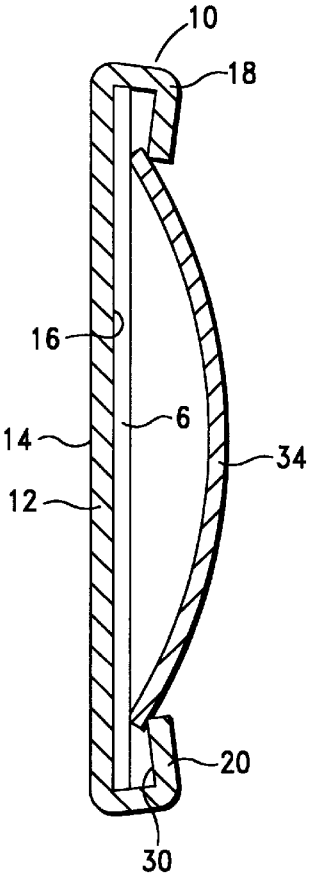
FIG. 5 is a sectional view showing insertion of a cover sheet into the display device.

As is shown particularly in FIG. 3, the retaining rails 18 and 20 each include a first stretch 26 transverse to the front surface 16 and a second stretch 28 extending inwardly from the first stretch 26 toward the center of the base member 12. In this embodiment, the first stretch 26 is oriented at an angle of about 78 to 82 degrees relative to the front surface 16 of the base member, while the second stretch 28 is oriented at an angle of about 90 degrees relative to the first stretch 26. In other modifications of the invention, the angle between the first stretch 26 and front surface 16 may be about 75 to 90 degrees. An elongate channel 30 is defined by the front surface 16 of the base member and the underside of the retaining rail. The edges of the articles are seated in the channels 30 with the retaining rails 18 and 20 holding the articles in the display device. The distance separating the upper and lower channels, or the height of the front surface 16 of the base member, is preferably equal to or slightly less than the height of the article to be positioned in the display. In the present embodiment, which is particularly suitable for displaying photographs having a dimension in one direction of 4 inches (such as standard 4 inch by 6 inch photographs), the distance separating the upper and lower channels is about 3.985 to 4 inches. As discussed above, the length of the second stretch 28 is approximately the same as the width of the side rails 22 and 24 to provide the appearance of a uniform frame surrounding the articles positioned in the display. The second stretch 28 terminates in an inner edge 32, with the inner edges 32 of the retaining rails 18 and 20 and the side rails 22 and 24 defining an opening which exposes a major portion of the front surface 16 of the base member 12 when the display device 10 is empty. When the display device 10 is in use, the photographs or other articles are displayed through the opening defined by the inner edges 32 and side rails 22 and 24.

The second stretch 28 of the retaining rails are of sufficient length to securely hold the photographs 6 or other articles in the display device 10 without obstructing a significant portion of the articles in the display. In this embodiment, the second stretch 28 has a length equivalent to approximately 4 to 5 percent of the length of the article in the direction of arrow A (FIG. 2). Thus, for a display device 10 for use with articles having a length in the direction A of about 4 inches, the second stretch 28 has a length of about 0.19 to 0.2 inches. In the illustrated modification, the retaining rails are formed of an opaque material, although it is to be understood that the retaining rails may be formed of a clear or transparent material so that the edges of the articles are displayed through the retaining rails 18 and 20.

The width of the channel 30, or the distance between the front surface 16 of the base member and the underside of the retaining rails 18 and 20, is such that the photographs or other articles are held in the desired position independent of the orientation of the display device 10. Turning to FIG. 1, the horizontal display device 10*a* is oriented such that the upper and lower edges of the photographs 6 or other articles are seated in the channels 30. With the vertical display device 10*b*, the retaining rails engage the left and right edges of the photographs. Display device 10*c* is positioned with the retaining rails 18 and 20 and elongate channels 30 inclined at an angle. In the illustrated embodiment, which is particularly suitable for displaying photographs 6, the channel 30 is about 0.045 to 0.060 inches wide.

An important advantage of the display device 10 of this invention is the ability to easily adjust the position of the photographs or other articles 6 in the device. The photographs 6 may be conveniently moved by engaging the portion of the photograph exposed through the opening defined by the retaining and side rails and sliding the photograph along the channel. As is shown particularly in FIG. 2, the photographs may be moved to positions where one photograph overlaps or extends across a portion of another photograph. The photographs or other articles may thereby be arranged to display only the portions of interest, maximizing the number of photographs which may be positioned in the display device 10 and enhancing the aesthetic appearance of the overall display by hiding undesirable or background sections of the photographs. With the display device of this invention, the effect of displaying only selected portions of the photographs is achieved without damaging the photographs, allowing the individual photographs to be later positioned in an album or individual frame where the entire photograph may be displayed. An individual viewing the display may also easily move the photographs to uncover the hidden sections without removing the display device from its position on the vertically-extending surface or removing the photographs from the display.

With the display device 10 of this invention, the photographs 6 or other articles may be conveniently positioned in the display 10 after the display device is installed. The ability to insert and remove photographs without removing the display device from the vertically extending surface minimizes the steps, effort and time required to insert and remove the photographs or other articles. The photographs 6 are positioned in the display device 10 by inserting the photographs through the opening defined by the retaining and side rails. As is shown particularly in FIG. 4, the photographs are inserted by flexing the photographs to a curved configuration and inserted the edges of the photograph behind the second stretch 28 of the retaining rails 18 and 20 and into the channels 30. The photographs may be easily removed by reversing this process. Thus, the display may be created, modified by adding or removing a photograph, or completely changed without removing the display device from the vertically-extending surface.

In the embodiment shown in FIGS. 1–4, the photographs are exposed through the opening defined by the retaining and side rails, leaving the photographs accessible at all times for adjusting the position of the photographs and adding or removing photographs from the display. In one modification of the invention, shown in FIG. 5, the display device 10 includes a cover sheet 34 for protecting the photographs from dust, finger prints, and the like. Cover sheet 34 is formed of a transparent, flexible material such as a clear polyvinyl chloride lens having a thickness of about 0.015 inches. The cover sheet 34 is positioned in the display device 10 in the same manner as the photographs or other articles by flexing the cover sheet 34 to a curved configuration and inserted the edges of the cover sheet into the channels 30. The cover sheet 34 is conveniently removed for adjusting the display or replacing photographs by reversing this process.

Figure 6:
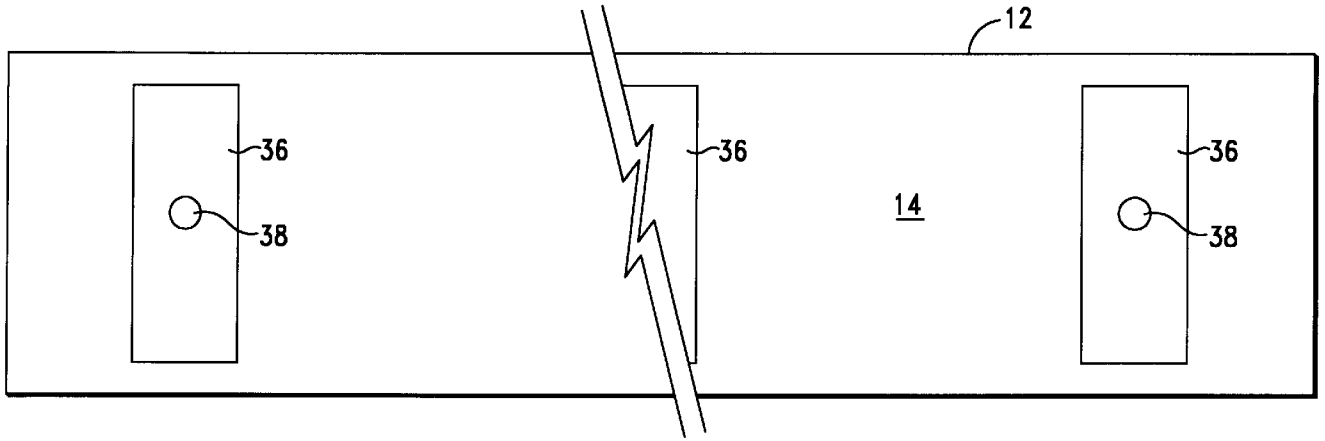
FIG. 6 is a back plan view of the display device of FIG. 1.

The display device 10 of this invention includes means for mounting the device 10 to the vertically-extending surface of a refrigerator, filing cabinet, wall, cubicle partition and the like. As is shown in FIG. 6, a plurality of magnet strips 36 have been mounted to the back surface 14 of the base member 12 for mounting the display device to a refrigerator or metal filing cabinet. In this embodiment, the display device 10 includes three, equally spaced rectangular magnet strips. However, it is to be understood that the size, shape, number and position of the magnet strips is subject to considerable variation within the scope of this invention. Apertures 38 are formed through the base member 12 and the outer magnet strips 36. The apertures may be used to mount the display device to walls, cubicle partitions and the like with push pins, nails, thumb tacks, or other fasteners. The display device 10 may be mounted to the vertically extending surface by holding the device against the surface and inserting the fastener through the aperture 38 and into the structure, with the fastener engaging an area of the front surface around the aperture 38. Alternatively, nails, thumb tacks or other fasteners may be mounted to the vertically extending surface and the display device installed by lifting the base members onto the fastener so that the fasteners extend through the apertures 38. Although not shown, the display device 10 may be installed using other means including for example adhesive materials which temporarily or permanently adhere the display device 10 to the vertically-extending surface.

Figure 7:
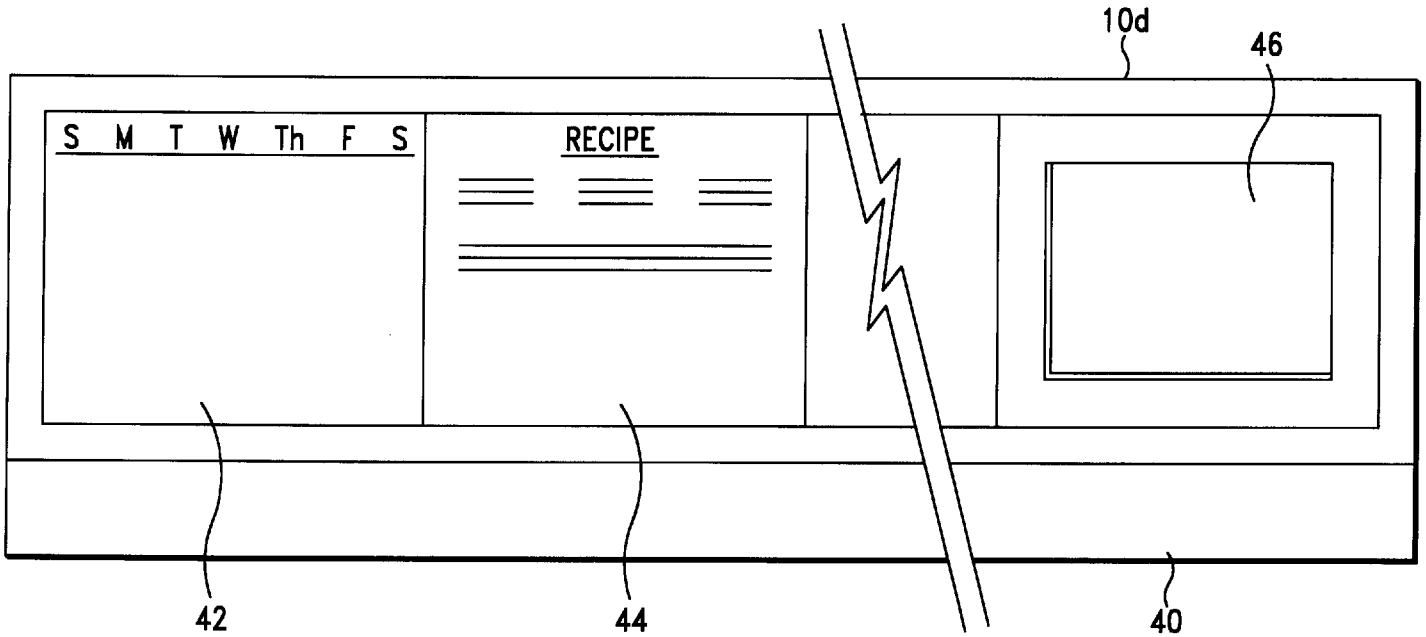
FIG. 7 is a front plan view of a display device in accordance with another embodiment of the invention.

FIG. 7 shows another embodiment of a display device 10*d*. The display device 10*d* includes a label strip 40 provided along the lower edge of the base member 12*d*. The label strip 40 may be marked with a description of the displayed photographs, a title for the display, or any other information which the user wishes to record. In this embodiment, the label strip is formed of a porcelainized enamel material or other dry erase materials and dry erase markers are used to write on the label strip. The label strip may also be formed of other materials of the type where ink applied to the surface may be easily removed or erased, as well as blackboard materials and the like. The label strip 40 may also be formed of cork board and the like, with the messages being applied by the board with push pins.

As is shown in FIG. 7, the display device of this invention may be used to display a variety of articles other than photographs. The display device 10*d* in FIG. 7 is shown displaying a sheet printed with one calendar month 42 and a recipe card 44. Although not shown, several calendar months may be positioned in the display behind the current month, with the user sliding the individual sheets along the channel to review future or previous months. Similarly, the display device 10 may be used to temporarily hold several overlapped recipe cards 44, with the user sliding the cards along the channels to follow the steps on the next card, review the ingredients listed on the previous card, or work on a separate recipe entirely. The display device 10*d* shown in FIG. 7 also holds the backing 46 of a stack of note sheets, retaining the note sheets in a central location for convenient access. It is to be understood that the display device of this invention may be used to display photographs, other articles, or a combination thereof.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A display device for displaying selected portions of a plurality of sheet-like articles comprising:

a base member having a back surface mountable to a vertically-extendinig structure, a front surface, spaced first and second elongate edges and spaced first and second side edges joining said elongate edges, retaining rails each having a proximal end joined to one of said elongate edges of said base member and a distal end spaced from said front surface of said base member, said retaining rails defining channels between the underside of said retaining rails and said front surface of said base member shaped to receive the edges of the articles and said distal ends of said retaining articles being configured to engage the articles and hold the articles in said display device, said distal ends of said retaining rails defining a display window between said retaining rails for displaying articles held by said display device, said display window providing an opening for the insertion of articles into and the removal of articles from said display device, said distal ends of said retaining rails being spaced from said front surface of said base member by a distance such that said distal ends of said retaining rails hold a plurality of articles in a selected display configuration independent of the orientation of said display device relative to the vertically-extending structure, and such that the articles retained by said distal ends of said retaining rails are movable relative to said base member upon application of pressure to the articles through said display window to slide the articles into a display configuration with at least one of the articles at least partially overlapping another of said articles.

2. The display device of claim 1 in which said distal ends of said retaining rails are separated from said front surface of said base member by a distance of 0.045 to 0.060 inches.

3. The display device of claim 1 in which said retaining rails are oriented at an angle relative to said front surface of said base member.

4. The display device of claim 1 in which said retaining rails are integrally formed with said base member.

5. The display device of claim 1, and further comprising side rails extending along said side edges of said base member.

6. The display device of claim 1, and further comprising a transparent cover sheet for protecting the articles positioned in said display device, said cover sheet being insertable through said display window and having edges positioned in said channels and said cover sheet being retained in said display device by said distal ends of said retaining rails when said cover sheet is mounted to said display.

7. The display device of claim 1, and further comprising at least one mounting member for mounting said base member to a vertically extending surface.

8. The display device of claim 1, and further comprising a label strip mounted to said display device.

9. In combination, the display device of claim 1 and a plurality of articles positioned in said display device.

10. In combination, a display device including a base member having a back surface mountable to a vertically-extending structure, a front surface, spaced first and second elongate edges and spaced first and second side edges joining said elongate edges, and retaining rails each having a proximal end joined to one of said elongate edges of said base member, the underside of said retaining rails and said front surface of said base member defining channels therebetween, said retaining rails each having a distal end spaced from said front surface of said base member, said distal ends of said retaining rails defining a display window, a plurality of sheet-like articles positioned in said display device for display through said display window by inserting said articles through said display window, said articles having edges positioned in said channels, said articles being held in place by said distal ends of said retaining rails, said articles being movable relative to said display device by engaging said articles through said display window and sliding said articles along said channel, said distal ends of said retaining rails holding said articles in a selected display configuration independent of the orientation of said display device relative to said vertically extending structure.

11. The combination of claim 10 in which at least one of said articles at least partially overlaps another of said articles.

12. The combination of claim 10 in which said articles are photographs.

13. The combination of claim 10 in which said distal ends of said retaining rails are separated from said front surface of said base member by a distance of 0.045 to 0.060 inches.

14. The combination of claim 10 in which said retaining rails are oriented at an angle relative to said front surface of said base member.

15. The combination of claim 10 in which said retaining rails are integrally formed with said base member.

16. The combination of claim 10 in which said display device includes side rails extending along said side edges of said base member.

17. The combination of claim 10, and further comprising a transparent cover sheet for protecting the articles positioned in said display device, said cover sheet being insertable through said display window, having edges positioned in said channels and said cover sheet being held in said display device by said distal ends of said retaining rails when said cover sheet is mounted to said display.

18. The combination of claim 10, and further comprising at least one mounting member for mounting said base member to a vertically extending surface.

19. The combination of claim 10, and further comprising a label strip mounted to said display device.

* * * * *